US006705832B2

(12) United States Patent
Tiemann

(10) Patent No.: US 6,705,832 B2
(45) Date of Patent: Mar. 16, 2004

(54) TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/220,490

(22) PCT Filed: Feb. 23, 2001

(86) PCT No.: PCT/EP01/02095

§ 371 (c)(1),
(2), (4) Date: Aug. 30, 2002

(87) PCT Pub. No.: WO01/65074

PCT Pub. Date: Sep. 7, 2001

(65) Prior Publication Data

US 2003/0021676 A1 Jan. 30, 2003

(30) Foreign Application Priority Data

Mar. 2, 2000 (EP) ..... 00104345

(51) Int. Cl.[7] ..... F01D 11/00

(52) U.S. Cl. ..... 415/116; 415/135; 415/138; 415/139; 415/191; 415/180; 60/756; 60/757; 60/800; 277/630; 277/637; 277/644; 277/647; 277/649

(58) Field of Search ..... 415/135–136, 415/138–139, 173.3, 174.2, 191, 115, 116, 180; 60/800, 755, 756, 757; 277/628, 630, 637, 644, 647, 649, 650

(56) References Cited

U.S. PATENT DOCUMENTS

| | | | | | |
|---|---|---|---|---|---|
| 3,728,041 | A | * | 4/1973 | Bertelson | 415/189 |
| 5,088,888 | A | * | 2/1992 | Bobo | 415/170.1 |
| 5,470,198 | A | | 11/1995 | Harrogate et al. | |
| 5,634,766 | A | * | 6/1997 | Cunha et al. | 415/115 |
| 5,823,741 | A | * | 10/1998 | Predmore et al. | 415/134 |
| 6,203,025 | B1 | * | 3/2001 | Hayton | 277/644 |

FOREIGN PATENT DOCUMENTS

| | | | | |
|---|---|---|---|---|
| EP | 0 298 897 A2 | | 1/1989 | |
| EP | 0 357 984 A1 | | 3/1990 | |
| EP | 0 921 273 A1 | | 6/1998 | |
| EP | 0 943 847 A2 | | 3/1999 | |
| JP | 60-22002 A | * | 2/1985 | 415/139 |
| WO | 98/53228 | | 5/1998 | |

* cited by examiner

*Primary Examiner*—Christopher Verdier
(74) *Attorney, Agent, or Firm*—Harness, Dickey & Pierce, P.L.C.

(57) ABSTRACT

A turbine includes a sealing element with a receiving area for sealing the guide blade vanes which are adjacent to each other in the peripheral direction of the turbine. The foot plates of the guide blade vanes extend into the receiving area. The edge area of the foot plates does not have to be reinforced compared to a conventional seal, which enables the entire foot plate to be cooled homogeneously. A closed cooling system can therefore be used for cooling, especially with steam.

22 Claims, 3 Drawing Sheets

TURBINE

This application is the national phase under 35 U.S.C. § 371 of PCT International Application No. PCT/EP01/02095 which has an International filing date of Feb. 23, 2001, which designated the United States of America and which claims priority on German Patent Application number EP 00104345.4 filed Mar. 2, 2000, the entire contents of which are hereby incorporated herein by reference.

FIELD OF THE INVENTION

The invention generally relates to a turbine, in particular a gas turbine.

BACKGROUND OF THE INVENTION

In a turbine, in particular in a gas turbine of a turbo set of a power station for energy generation, a hot gas is led through the turbine. A result is that a shaft having moving blades arranged on it is driven. This shaft is connected, as a rule, to a generator for the generation of energy. The moving blades extend radially outward. Stationary guide vanes are arranged in the opposite direction, that is to say radially from the outside inward. As seen in the longitudinal direction of the turbine, the guide vanes and the moving blades engage one into the other in a tooth-like manner.

The turbine, as a rule, has a plurality of turbine stages, a guide vane ring being arranged in each stage. Thus, a plurality of the guide vanes are arranged next to one another in the circumferential direction of the turbine. The individual guide vane rings are arranged successively in the axial direction. The flow path of the hot gas through the turbine is designated hereafter as the gas space.

The guide vanes each include a vane leaf which extends radially into the gas space and is attached to a foot plate, via which the guide vane is fastened to what is known as a guide vane carrier. The individual foot plates of the guide vanes form an essentially closed surface and outwardly delimit the gas space. In order to achieve as small leakage gaps as possible between the individual foot plates, seals are provided, as a rule, between the individual foot plates.

In a conventional seal variant, the foot plate edge region is made thickened, particularly in the case of foot plates adjacent to one another in the circumferential direction, an end-face groove being worked into the thickening. For sealing, a common sealing sheet is introduced into mutually opposite grooves of adjacent foot plates.

The massive construction of the edge region in which the groove for the sealing sheet is arranged presents problems in terms of the thermal load on the foot plate. On account of the high temperatures in the turbine, the foot plates are normally cooled by way of a coolant. In this case, special cooling measures have to be taken for the massive edge region, so as not to give rise to any excessive thermal stresses between the massive edge region and the relatively thin plate region of the foot plate.

This problem is aggravated when a closed cooling circuit, for example a closed steam cooling circuit, is provided for cooling, since this does away with the possibility of guiding through the massive edge region cooling bores through which, for example, cooling air can flow. Instead, in the case of a closed cooling circuit, such bores have to be produced as blind holes, the cooling effect naturally being low in this case, since the cooling medium will scarcely flow through the blind hole to a sufficient extent.

In a further seal variant, the grooves and the sealing sheet are set back from the hot-gas side located on the gas-space side and an undercut is introduced into the massive edge region below the sealing element. Here, too, there is then again the problem of the coolant flowing through this undercut to a sufficient extent. A third seal variant, according to which cooling ducts are introduced into the body of the foot plate itself, is complicated in production terms.

In particular, here, there is the problem that, in order to form the cooling ducts during the casting of the foot plate, a core which is positioned via spacers, also has to be cast in. The core and the spacers are removed by way of suitable measures after casting, so that the cavities formed thereby can be used as cooling ducts. However, there is a connection of the cooling ducts to the outside via the cavity produced by the spacers, so that a closed cooling circuit can be implemented only with difficulty.

SUMMARY OF THE INVENTION

An object on which an embodiment of the invention may be based is, in a turbine, to design the seal between adjacent guide vanes suitably for simple cooling.

An object may be achieved, according to an embodiment of the invention, by a turbine, in particular by a gas turbine, with a gas space and with a number of guide vanes which each have a foot plate and a vane leaf extending radially from the foot plate into the gas space, a sealing element with a reception region, into which the foot plates extend, being provided in each case between the foot plates of adjacent guide vanes.

The fundamental idea of this configuration is to be seen in the reversal of the conventional sealing principle, in which a sealing sheet is introduced into corresponding grooves of the foot plates. To be precise, this necessarily requires a reinforcement of the edge of the foot plates in the groove region, thus ultimately leading to the cooling problems. In this case, in a reversal of this sealing principle, the sealing sheet is not inserted into the foot plates, but, instead, the foot plates are introduced into the sealing element. This avoids the need for a reinforcement of the edge region of the foot plate. Coolability is therefore simplified and the foot plate is cooled homogeneously in all regions, so that no thermal stresses occur.

In a preferred design, the sealing element is designed with an H-shaped cross section with two longitudinal limbs connected via a transverse limb, there being formed between the longitudinal limbs two reception regions which are separated from the transverse limb and into which the foot plates of adjacent guide vanes extend in each case. The sealing element thus partially covers the adjacent foot plates with its two longitudinal limbs, so that, in addition to the sealing property, the foot plates are held by the sealing element.

In view of assembly requirements during the production of the turbine, the sealing element is arranged preferably between guide vanes adjacent to one another in the circumferential direction of the turbine.

According to a preferred refinement, the foot plates each have a side edge bent away from the gas space, in particular radially outward, the sealing element being arranged between two side edges of adjacent guide vanes. The effective sealing height of the seal is thereby increased, without the plate thickness of the foot plate being increased. The two bent-away side edges of the foot plates in this case come to bear, in particular, on the transverse limb of the H-shaped sealing element.

In order to achieve homogeneous cooling and consequently avoid thermal stresses, the side edge has substantially the same material thickness as the remaining foot plate.

In order to prevent the sealing element from projecting into the gas space, the front side of the foot plate, the front side being directed toward the gas space, has, in the region of the sealing element, a bearing surface which is set back from the gas space and on which the sealing element lies. Preferably, at the same time, the sealing element is flush with the foot plate.

In an expedient refinement, there is, for cooling the sealing element, a flow path in the form of a leakage gap for air between the sealing element and the foot plates. There is therefore no desire to have absolute leak-tightness, in order to keep low the thermal load in the region of the sealing element and at the side edges of the foot plate. As a rule, the outside space around the gas space in a turbine is kept at a higher pressure than the gas space, so that air enters the gas space from outside via the leakage gap and the outflow of hot gas from the gas space is avoided.

In a particularly advantageous embodiment, a closed cooling system, through which a coolant is capable of flowing, is arranged in the rear region of the foot plates which faces away from the gas space, that is to say in the outside space. The coolant is in this case, in particular, steam. Alternatively, the coolant used is also a liquid, such as water, or another gas, such as air or hydrogen. Such a closed cooling system allows an effective, directional and homogeneous cooling of the foot plates and of the entire guide vanes.

Preferably, at the same time, the coolant is capable of flowing, in particular directly, over the rear side of the foot plates which faces away from the gas space, so that direct heat exchange takes place between the coolant and the foot plate.

In order to achieve an effective cooling of the foot plates, an inflow duct for the coolant is formed between an outer guide sheet and a baffle sheet, the baffle sheet being arranged between the outer guide sheet and the foot plate and having flow orifices toward the foot plate, and a return-flow duct for the cooling medium being formed between the baffle sheet and the foot plate. A closed cooling system, which has a high cooling action, is consequently implemented in a simple way. During operation, the coolant is supplied via the inflow duct and is guided at high velocity onto the foot plate via the, in particular, nozzle-like flow orifices in the baffle sheet, so that intensive heat exchange takes place between the coolant and the foot plate. The heated coolant is subsequently discharged in the return-flow duct.

Preferably, the baffle sheet is supported on the foot plate via a supporting element, so that the baffle sheet is held at a defined distance from the foot plate.

For simple fastening, preferably the baffle sheet is fastened to the bent-away side edge of the foot plate and the guide sheet is fastened, in particular, to the baffle sheet.

In order to achieve a simple mounting of the foot plates and at the same time good sealing of the foot plates both in the circumferential direction and in the axial direction between adjacent turbine stages, preferably the sealing element described is provided for sealing in the circumferential direction and a further sealing element is provided for sealing in the axial direction. Depending on the direction, therefore, and particularly for assembly reasons, differently designed sealing elements are used.

The further sealing element connects the foot plates to one another in a staple-like manner, preferably on their rear sides facing away from the gas space. The essential advantage is in this case to be seen in the staple-like configuration of the further sealing element which spans the two foot plates. The further sealing element is in this case designed to be elastic, in particular in a plurality of directions, so that, under thermal expansions, it follows the foot plates, without opening up a gap. The sealing by the further sealing element is therefore largely unaffected by thermal expansions.

BRIEF DESCRIPTION OF THE DRAWINGS

Exemplary embodiments of the invention are explained in more detail below with reference to the drawings, in which, in each case in a highly diagrammatical illustration.

DETAILED DESCRIPTION OF THE PREFERRED EMBODIMENTS

Figure 1:
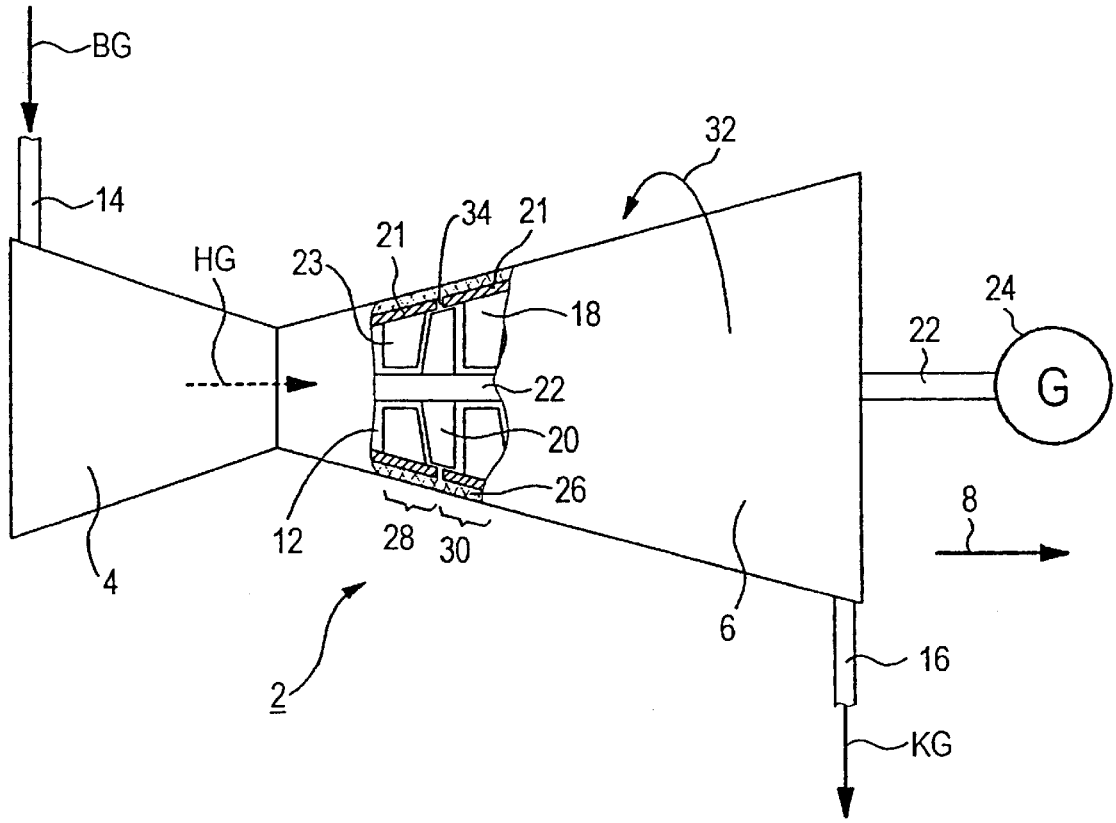
FIG. 1 shows a turbine plant.

According to FIG. 1 a turbine plant 2, in particular a gas turbine plant of a turbo set for a power station for energy generation, comprises a combustion chamber 4 and a turbine 6 which is arranged downstream of the combustion chamber 4 in the longitudinal or axial direction 8 of the turbine plant 2. The turbine 6 is illustrated, cut away, in a part region, so that it is possible to look into the gas space 12 of the turbine 6. The flow path of a hot gas HG through the turbine 6 is designated as the gas space 12.

During operation, the combustion chamber 4 is supplied via a gas supply 14 with a fuel gas BG which is burnt in the combustion chamber 4 and which forms said hot gas HG. The hot gas HG flows through the turbine 6 and leaves the latter as cold gas KG via a gas discharge line 16. The hot gas HG is guided in the turbine 6 via guide vanes 18 and moving blades 20. In this case, a shaft 22, on which the moving blades 20 are arranged, is driven. The shaft 22 is connected to a generator 24 for the generation of electric energy.

The moving blades 20 extend radially outward from the shaft 22. The guide vanes 18 have a foot plate 21 and a vane leaf 23 fastened to the latter. The guide vanes 20 are fastened outwardly to the turbine 6 via their foot plate 21 in each case on what is known as a guide vane carrier 26 and extend radially into the gas space 12. As seen in the longitudinal direction 8, the guide vanes 18 and the moving blades 20 engage one into the other in a tooth-like manner. A plurality of moving blades 20 and of guide vanes 18 are in each case combined to form a ring, each guide vane ring representing a turbine stage.

In the exemplary embodiment of FIG. 1, the second turbine stage 28 and the third turbine stage 30 are illustrated by way of example.

The foot plates 21 of the individual guide vanes 18 are contiguous to one another both in the axial direction 8 and in the circumferential direction 32 of the turbine 6 and outwardly delimit the gas space 12.

The foot plates 21 adjacent to one another are sealed relative to one another, in order to keep leakage gaps 34 between them as small as possible.

Figure 2:
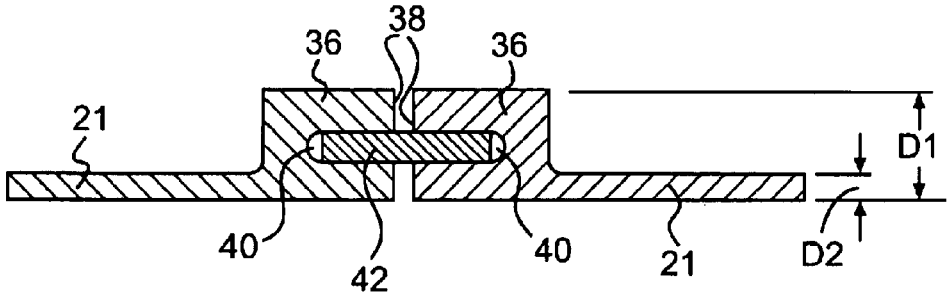
Fig. 2 PRIOR ART
FIG. 2 shows the sealing region between two foot plates adjacent to one another in the circumferential direction of the turbine, in a conventional embodiment.

According to a conventional seal variant for two foot plates 21 arranged next to one another in the circumferential direction 32, the latter have a thickened edge region 36, as shown in FIG. 2. Grooves 40 which are located opposite one another and into which a common sealing sheet 42 is inserted are worked into the end faces 38 of the edge regions 36 of adjacent foot plates 21. This sealing principle, according to which the foot plates 21 receive a sealing element in the form of a sealing sheet 42, necessarily requires the reinforced edge region 36. As a rule, this edge region 36 has a thickness D1 higher by the factor 3 to the factor 5 than the thickness D2 of the remaining foot plate 21.

These different material thicknesses in the edge region 36 and the remaining foot plate 21 lead to problems in terms of a uniform and homogeneous cooling of the foot plates 21, so that there is a risk of thermal stresses.

Figure 3:
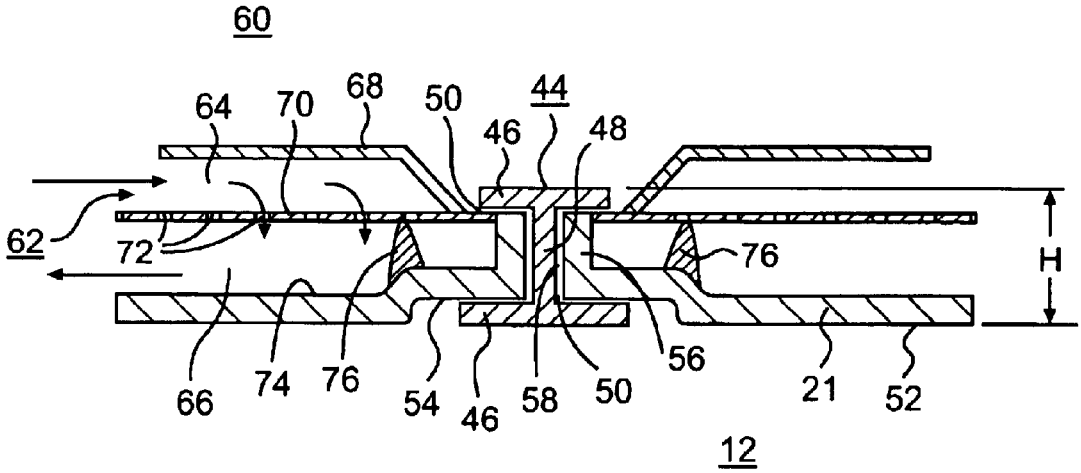
FIG. 3 shows the sealing region in a configuration according to an embodiment of the invention.

In order to avoid this problem, according to the proposed preferred embodiment shown in FIG. 3, the conventional sealing principle is reversed, so that, in this case, the foot plates 21 extend into a sealing element 44. The sealing element 44 is designed with an H-shaped cross section and has two longitudinal limbs 46 which are connected to one another via a transverse limb 48.

The sealing element 44 is therefore designed in the manner of a "double-T girder". Between the two longitudinal limbs 46 are formed two reception regions 50 which are separated from the transverse limb 48 and into which the foot plates 21 extend. Alternatively to the H-shaped design, the sealing element 44 has a T-shaped design, that is to say with only one longitudinal limb 46. In a sealing element 44 of this kind, the reception spaces formed are open.

In the region of the sealing element 44, the front sides 52 of the foot plates 21, the front sides being oriented toward the gas space 12, each have a bearing surface 54 which is set back from the gas space 12 and on which one longitudinal limb 56 of the sealing element 44 lies. For this purpose, the foot plate 21 has a step-shaped design in the region of the sealing element 44. The end regions of the foot plates 21, said end regions adjoining the step, are bent away outward from the gas space 12 approximately perpendicularly and in each case form a bent-away or radially extending side edge 56. The side edges 56 of the adjacent foot plates 21 directly fit snugly against the transverse limb 48. An increase in sealing height H is thereby achieved, without the foot plate 21 being reinforced in the sealing region. A flow path 58 designed as a leakage gap is formed between the sealing element 44 and at least one of the foot plates 21, so that, for example, air from the outside space 60 facing away from the gas space 12 can flow via the flow path 58 into the gas space 12 and therefore cools the sealing region, that is to say the sealing element 44 and the side edges 56.

To cool the foot plates 21, in particular, a closed cooling system 62 is provided, which uses preferably steam as a coolant and a detail of which is illustrated in FIG. 3. This closed cooling system 62 has an inflow duct 64 and a return-flow duct 66. The inflow duct 64 is formed between an outer guide sheet 68 and a baffle sheet 70 which is arranged between the guide sheet 68 and the foot plate 21.

The baffle sheet 70 has flow orifices 72 which are designed in the manner of nozzles, so that the coolant supplied via the inflow duct 64 flows over into the return-flow duct 66 along the arrows illustrated. By virtue of the nozzle-like operation of the flow orifices 72, the coolant is guided at high velocity against the rear side 74 of the foot plate 21, so that effective heat transmission between the coolant and the foot plate 21 is implemented.

In order to achieve a uniform action of the cooling system 62, the baffle sheet 70 is supported against the foot plate 21 and kept at a distance from the latter via supporting elements 76, for example in the form of weld spots or welded webs. The baffle sheet 70 is directly fastened, in particular welded, to the side edge 56 of the foot plate 21, and the guide sheet 68 is fastened to the baffle sheet 70.

For assembly and cooling reasons, the sealing arrangement illustrated in FIG. 3 is provided, in particular, for two guide vanes 18 adjacent to one another in the circumferential direction 32. The illustrated inflow ducts 64 and return-flow ducts 66 therefore extend in the axial direction 8 of the turbine 6. The foot plates 21 of a guide vane ring are thus sealed relative to one another via the H-shaped sealing element 44. For assembly reasons, this seal is less suitable, albeit possible in principle, for foot plates 21 of successive turbine stages 28, 30, said foot plates being adjacent to one another in the axial direction 8.

Figure 4:
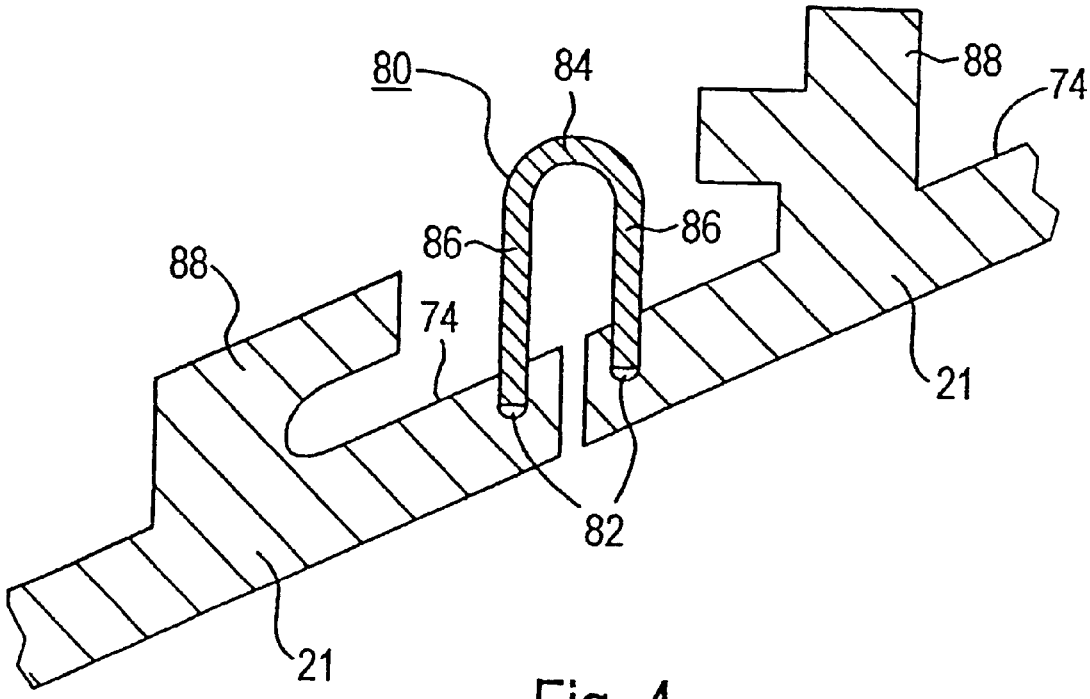
FIG. 4 shows a seal provided, in particular, for foot plates arranged next to one another in the axial direction of the turbine plant.

For the sealing of foot plates 21 adjoining one another in the axial direction 8, according to FIG. 4 a further sealing element 80 is preferably provided, which connects the foot plates 21 to one another in a staple-like manner on their rear sides 74. The further sealing element 80 is in this case introduced and fastened in grooves 82 which extend essentially radially from the rear side 74 into the foot plates 21. As illustrated in FIG. 4, the further sealing element 80 is, for example, of U-shaped design with two limbs 86 connected via an arc 84.

Alternatively to this, the further sealing element 80 is provided with a wavy structure in the manner of a concertina. The elongate U-shaped configuration or else the configuration with the wavy structure has the effect that the further sealing element 80 is elastic and allows all-round movability of the foot plates 21 as a result of thermal expansion. FIG. 4 also illustrates hooking elements 88 which are arranged on the rear sides 74 and by means of which the guide vanes 18 are hooked into the guide vane carrier 26 (cf. FIG. 1).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine, comprising:

a plurality of guide vanes, each including a foot plate and a vane leaf extending radially from the foot plate into a gas space; and a sealing element, including a reception region into which the foot plates extend, wherein the sealing element is provided between foot plates of adjacent guide vanes, wherein the sealing element includes an H-shaped cross section with two longitudinal limbs connected via a transverse limb, and includes two reception regions, formed between the longitudinal limbs, which are separated from the transverse limb and into which the foot plates of adjacent guide vanes extend.

2. The turbine as claimed in claim 1, wherein a closed cooling system, through which a coolant is capable of flowing, is arranged in the rear region of the foot plates which faces away from the gas space.

3. The turbine as claimed in claim 2, wherein the coolant is capable of flowing over the rear side of the foot plates which faces away from the gas space.

4. The turbine as claimed in claim 3, wherein an inflow duct for the coolant is formed between an outer guide sheet and a baffle sheet arranged between the outer guide sheet and the foot plate and includes flow orifices toward the foot plate, a return-flow duct for the cooling medium being formed between the baffle sheet and the foot plate.

5. The turbine as claimed in claim 2, wherein an inflow duct for the coolant is formed between an outer guide sheet and a baffle sheet arranged between the outer guide sheet and the foot plate and includes flow orifices toward the foot plate, a return-flow duct for the cooling medium being formed between the baffle sheet and the foot plate.

6. The turbine as claimed in claim 5, wherein the baffle sheet is supported on the foot plate via a supporting element.

7. The turbine as claimed in claim 5, wherein the baffle sheet is fastened to a bent-away side edge of the foot plate and the guide sheet is fastened to the baffle sheet.

8. The turbine of claim 1, wherein the turbine is a gas turbine.

9. The turbine as claimed in claim 1, wherein the foot plates each include a side edge bent away outwardly from the gas space, the sealing element being arranged between two side edges of adjacent guide vanes.

10. The turbine as claimed in claim 9, wherein the side edge has substantially the same material thickness as the remaining foot plate.

11. The turbine as claimed in claim 1, wherein the front side of the foot plate, directed toward the gas space, includes, in the region of the sealing element, a bearing surface for the sealing element, said bearing surface being set back from the gas space.

12. The turbine as claimed in claim 11, wherein the sealing element is flush with the foot plate.

13. The turbine as claimed in claim 1, wherein the sealing element is arranged between foot plates adjacent to one another in the circumferential direction, and wherein foot plates adjacent to one another in the axial direction, are assigned a further sealing element which connects the foot plates to one another in a staple-like manner on their rear sides facing away from the gas space.

14. A turbine, comprising:

a plurality of guide vanes, each including a foot plate and a vane leaf extending radially from the foot plate into a gas space; and a sealing element, including a reception region into which the foot plates extend, wherein the sealing element is provided between foot plates of adjacent guide vanes, wherein the foot plates each include a side edge bent away outwardly from the gas space, the sealing element being arranged between two side edges of adjacent guide vanes.

15. The turbine as claimed in claim 14, wherein the side edge has substantially the same material thickness as the remaining foot plate.

16. The turbine as claimed in claim 14, wherein for cooling the sealing element, a flow path for air is included between the sealing element and the foot plates.

17. The turbine as claimed in claim 14, wherein the sealing element is arranged between foot plates adjacent to one another in the circumferential direction, and wherein foot plates adjacent to one another in the axial direction, are assigned a further sealing element which connects the foot plates to one another in a staple-like manner on their rear sides facing away from the gas space.

18. A turbine comprising:

a plurality of guide vanes, each including a foot plate and a vane leaf extending radially from the foot plate into a gas space; and a sealing element, including a reception region into which the foot plates extend, wherein the sealing element is provided between foot plates of adjacent guide vanes, wherein the front side of the foot plate, directed toward the gas space, includes, in the region of the sealing element, a bearing surface for the sealing element, said bearing surface being set back from the gas space.

19. The turbine as claimed in claim 18, wherein the sealing element is arranged between guide vanes adjacent to one another in the circumferential direction of the turbine.

20. The turbine as claimed in claim 18, wherein the sealing element is flush with the foot plate.

21. A turbine, comprising:

a plurality of guide vanes, each including a foot plate and a vane leaf extending radially from the foot plate into a gas space; and a sealing element, including a reception region into which the foot plates extend, wherein the sealing element is provided between foot plates of adjacent guide vanes, wherein the sealing element includes an H-shaped cross section with two longitudinal limbs connected via a transverse limb, and includes two reception regions, formed between the longitudinal limbs, which are separated from the transverse limb and into which the foot plates of adjacent guide vanes extend, and wherein the sealing element is arranged between guide vanes adjacent to one another in the circumferential direction of the turbine.

22. A turbine, comprising:

a plurality of guide vanes, each including a foot plate and a vane leaf extending radially from the foot plate into a gas space; and a sealing element, including a reception region into which the foot plates extend, wherein the sealing element is provided between foot plates of adjacent guide vanes, wherein the sealing element includes an H-shaped cross section with two longitudinal limbs connected via a transverse limb, and includes two reception regions, formed between the longitudinal limbs, which are separated from the transverse limb and into which the foot plates of adjacent guide vanes extend, and wherein for cooling the sealing element, a flow path for air is included between the sealing element and the foot plates.

* * * * *